US011054087B2

(12) United States Patent
Cairns et al.

(10) Patent No.: US 11,054,087 B2
(45) Date of Patent: Jul. 6, 2021

(54) LIGHT EMITTING DIODE (LED) FILAMENT LIGHT BULB WITH SECURED ANTENNA

(71) Applicant: Technical Consumer Products, Inc., Aurora, OH (US)

(72) Inventors: Dustin Cairns, Rootstown, OH (US); George J. Uhler, Wadsworth, OH (US); Paul Phillips, Aurora, OH (US); Jimmy Zheng, Aurora, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 0 days.

(21) Appl. No.: 16/711,597

(22) Filed: Dec. 12, 2019

(65) Prior Publication Data

US 2020/0116308 A1 Apr. 16, 2020

Related U.S. Application Data

(63) Continuation of application No. 16/131,906, filed on Sep. 14, 2018, now Pat. No. 10,544,907.

(Continued)

(51) Int. Cl.
*F21K 9/232* (2016.01)
*F21K 9/237* (2016.01)

(Continued)

(52) U.S. Cl.
CPC ..... *F21K 9/232* (2016.08); *F21K 9/235* (2016.08); *F21K 9/237* (2016.08); *F21K 9/238* (2016.08);

(Continued)

(58) Field of Classification Search
CPC ..... F21K 9/232–237; F21K 9/90
See application file for complete search history.

(56) References Cited

U.S. PATENT DOCUMENTS

2008/0295522 A1‡ 12/2008 Hubbell ..... F21K 9/00 62/3.2
2013/0136454 A1‡ 5/2013 Yu ..... H05B 33/0803 398/106

(Continued)

FOREIGN PATENT DOCUMENTS

CN 206145458 U ‡ 5/2017
CN 206145458 U 5/2017
WO 2013/014821 A1 1/2013

OTHER PUBLICATIONS

PCT, U.S. Patent and Trademark Office (ISA/US), International Search Report and Written Opinion of the International Searching Authority, International Application No. PCT/US2018/051114, 11 pages (dated Mar. 13, 2019).

(Continued)

*Primary Examiner* — Mariceli Santiago
(74) *Attorney, Agent, or Firm* — Norton Rose Fulbright US LLP

(57) ABSTRACT

A light emitting diode (LED) filament light bulb is disclosed. The LED filament light bulb includes a plurality of LED filaments, an RF driver, an antenna, and a cover. The antenna defines a first end portion and a second end portion, where the first end portion of the antenna is electrically connected and in signal communication with the RF driver. The cover defines an external wall and a support structure. The external wall defines an interior volume and the support structure defines an evacuation passageway and a cavity. The evacuation passageway and the antenna are both received within the cavity of the support structure and the evacuation passageway is fluidly connected to the interior volume of the cover.

6 Claims, 9 Drawing Sheets

Related U.S. Application Data

(60) Provisional application No. 62/559,045, filed on Sep. 15, 2017.

(51) Int. Cl.

| | |
|---|---|
| ***F21V 23/04*** | (2006.01) |
| ***F21V 31/00*** | (2006.01) |
| ***F21K 9/90*** | (2016.01) |
| ***F21V 23/00*** | (2015.01) |
| ***F21K 9/235*** | (2016.01) |
| ***F21K 9/238*** | (2016.01) |
| *F21Y 115/10* | (2016.01) |

(52) U.S. Cl.

CPC ..... *F21K 9/90* (2013.01); *F21V 23/003* (2013.01); *F21V 23/006* (2013.01); *F21V 23/0435* (2013.01); *F21V 31/00* (2013.01); *F21V 31/005* (2013.01); *F21Y 2115/10* (2016.08)

(56) References Cited

U.S. PATENT DOCUMENTS

| | | | |
|---|---|---|---|
| 2015/0043212 | A1 | 2/2015 | Coffey et al. |
| 2016/0135270 | A1 | 5/2016 | Earl et al. |
| 2016/0227631 | A1 | 8/2016 | Weedon, III et al. |
| 2016/0341409 | A1 | 11/2016 | Chen et al. |
| 2016/0366746 | A1 | 12/2016 | Van De Ven et al. |
| 2017/0059095 | A1‡ | 3/2017 | Van Bommel ..... H05B 37/0272 |
| 2017/0130906 | A1 | 5/2017 | Jiang et al. |

OTHER PUBLICATIONS

U.S. Patent and Trademark Office, Non-Final Office Action, U.S. Appl. No. 16/131,906, 15 pages, dated Jun. 6, 2019.

‡ imported from a related application

LIGHT EMITTING DIODE (LED) FILAMENT LIGHT BULB WITH SECURED ANTENNA

TECHNICAL FIELD

The present disclosure relates generally to a light emitting diode (LED) filament light bulb, and more particularly to an LED filament light bulb that includes a cover and an antenna, where the cover includes a support structure that secures the antenna in place.

BACKGROUND

Light emitting diode (LED) based lighting systems may offer several energy and reliability advantages over other types of lighting systems such as, for example, incandescent or fluorescent lighting. Thus, LED based lighting systems are increasingly being used to replace other existing lighting technologies. Although LED based lighting systems offer numerous advantages and benefits, there are still some challenges that may be faced when using this technology. For example, LED light bulbs have an unconventional appearance that is markedly different from that of an incandescent light bulb. This is because the LED chips that emit illumination are typically positioned in a horizontal orientation upon a base portion disposed within the dome of the LED light bulb. In contrast, an incandescent light bulb includes a wire filament that is suspended within the dome of the bulb and heated to glow with visible light.

Some consumers prefer the appearance of a typical incandescent light bulb when compared to an LED light bulb. Accordingly, LED filament light bulbs that mimic the appearance of an incandescent light bulb have been introduced to address this need. An LED filament light bulb includes one or more strings of LEDs that resemble a filament. Although clear filament light bulbs are popular from an aesthetic perspective, design issues may be encountered when integrating intelligent control components such as, for example, a driver board and an antenna within such bulbs. Specifically, the components that provide intelligent control are frequently located within the base of the light bulb. Since an LED filament light bulb generally includes an open base, the components may be visible to a user. In one approach to hide the components from view, an opaque dome is provided to conceal the control board and other components used for intelligent LED light bulbs. However. the opacity of the dome negates the aesthetic character sought by consumers who purchase clear filament light bulbs. Accordingly, there is a continuing need in the art for improvements that address the above-mentioned issues that conventional LED filament light bulbs may encounter.

DETAILED DESCRIPTION

Figure 1:
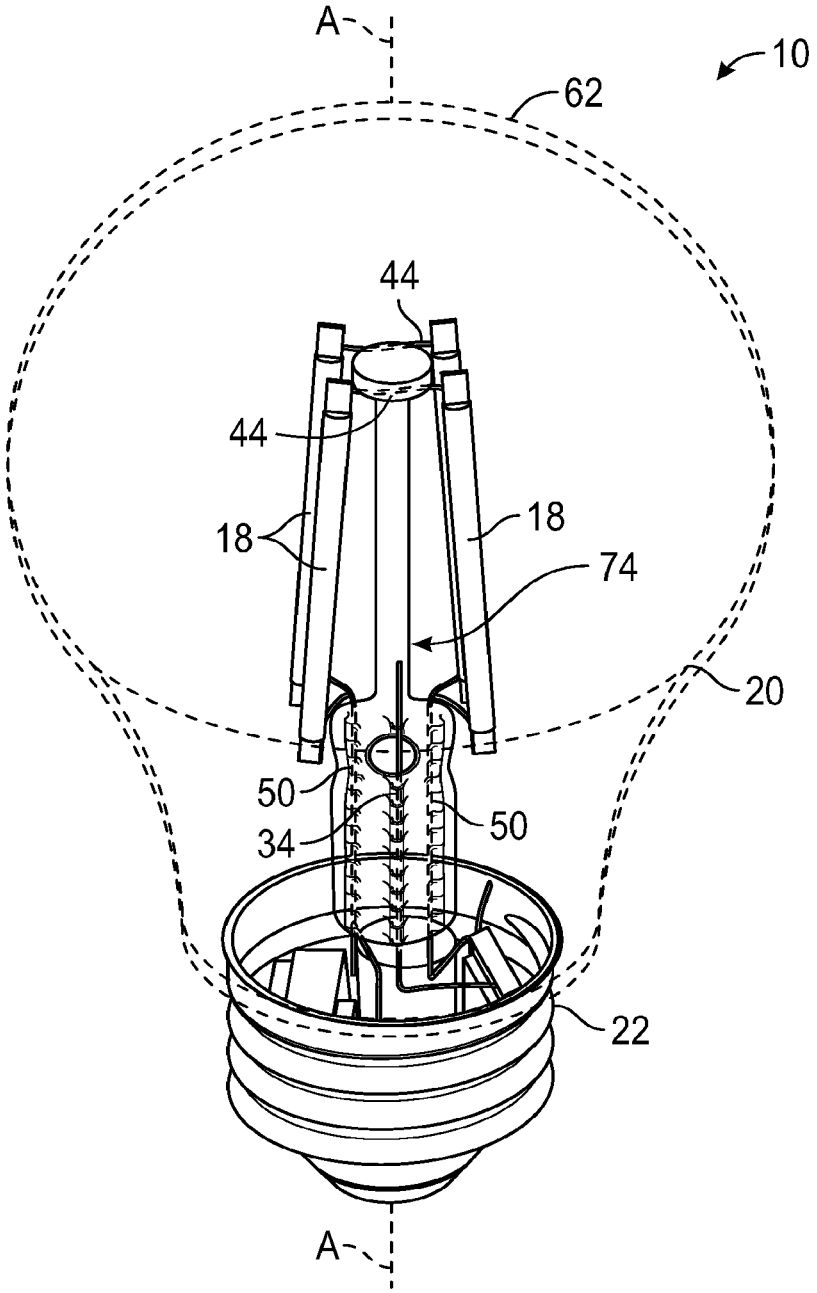
FIG. 1 is an elevational view of the disclosed LED filament light bulb including a cover.

The following detailed description will illustrate the general principles of the invention, examples of which are shown in the accompanying drawings. In the drawings, like reference numbers indicate identical or functionally similar elements.

FIG. 1 is an elevated view of an exemplary light emitting diode (LED) filament light bulb 10. The LED filament light bulb 10 is an electric light bulb that produces visible light using a plurality of LED filaments 18 that are each configured to resemble a filament of an incandescent light bulb. In the exemplary embodiment as shown in the figures, the LED filament light bulb 10 is depicted as a classic or standard A19 bulb. Specifically, the LED filament light bulb 10 as shown in the figures includes a dome or cover 20 shaped as an A19 bulb. The LED filament light bulb 10 also includes an Edison screw base 22 attached to the cover 20. The LED filament light bulb 10 includes the A19 configuration and the Edison screw base because these features are commonly seen in incandescent lights. However, it is to be appreciated that the figures are merely exemplary in nature, and the LED filament light bulb 10 is not limited to the A19 configuration.

Figure 2:
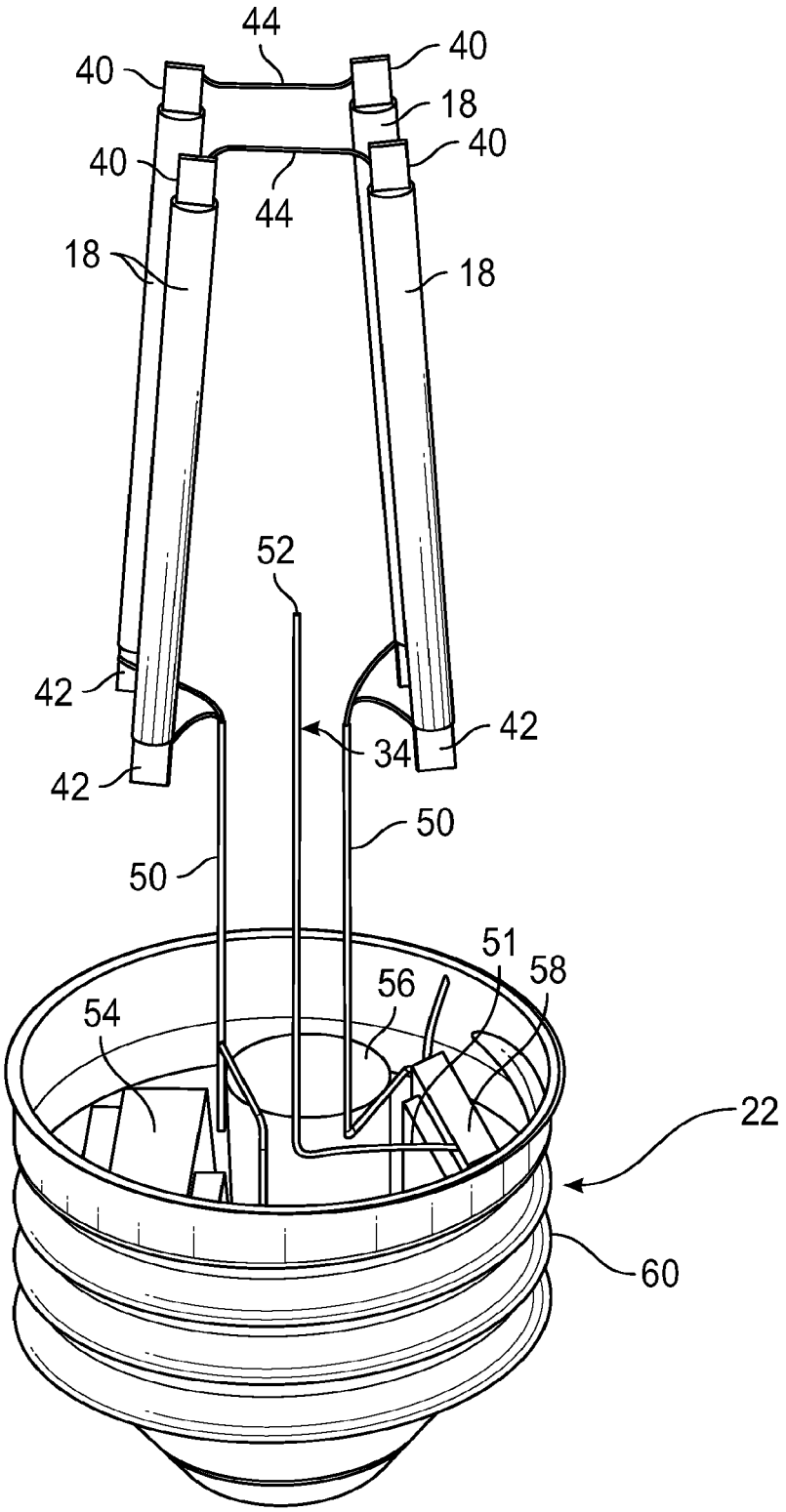
FIG. 2 is an illustration of the LED filament light bulb shown in FIG. 1, where the cover has been removed in order to more clearly show the LED filaments, an antenna, and various intelligent control components.

FIG. 2 is an illustration of the LED filament light bulb 10 shown in FIG. 1, where the cover 20 has been removed in order to more clearly show the LED filaments 18, an antenna 34, and various electrical components located within the base 22, such as a driver board 54, a capacitor 56, and a RF driver 58. The LED filaments 18 are each composed of a series of LEDs (not visible in the figures) on a transparent substrate, where the transparent substrate may be a glass or sapphire material. The transparent substrate allows for the light emitted by the LEDs to disperse evenly and uniformly. The LED filaments 18 are also coated with yellow phosphor to convert blue light generated by the LEDs into white light. In the embodiment as illustrated, four LED filaments 18 are shown, however the LED filament light bulb 10 may include any number of LED filaments 18.

The antenna 34, the driver board 54, and the RF driver 58 are used to provide intelligent or wireless control for the LED filament light bulb 10. Thus, the LED filament light bulb 10 may be controlled remotely using wireless communication such as radio frequency (RF) signals. Referring to both FIGS. 1 and 2, the cover 20 may be constructed of an unleaded glass that allows for the passage of RF signals. In one embodiment, the cover 20 is constructed of substantially transparent unleaded glass. The driver board 54 includes various power electronics (not illustrated) for providing power to the LED filaments 18 as well as a microcontroller. The RF driver 58 may be a receiver, a transmitter, or a transceiver.

Figure 3:
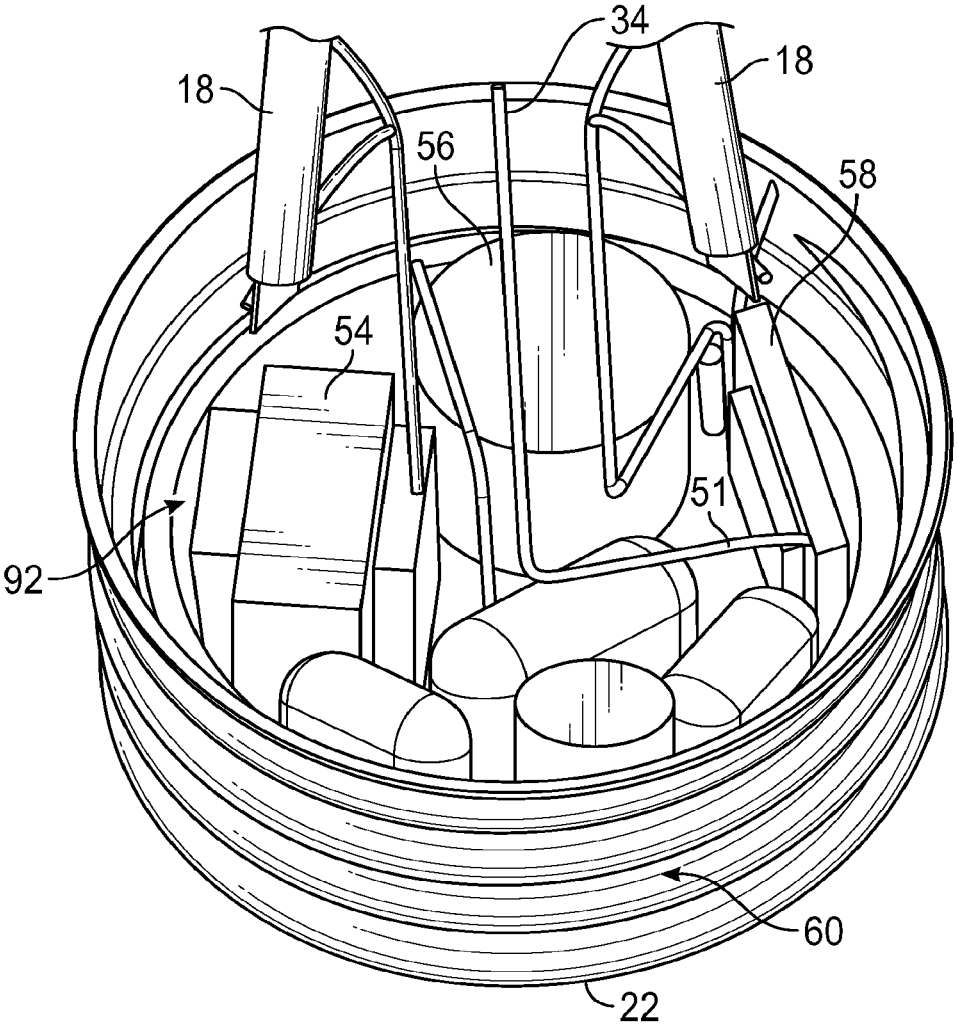
FIG. 3 is an enlarged, elevational view of the base of the LED filament light bulb shown in FIG. 2.
Figure 5:
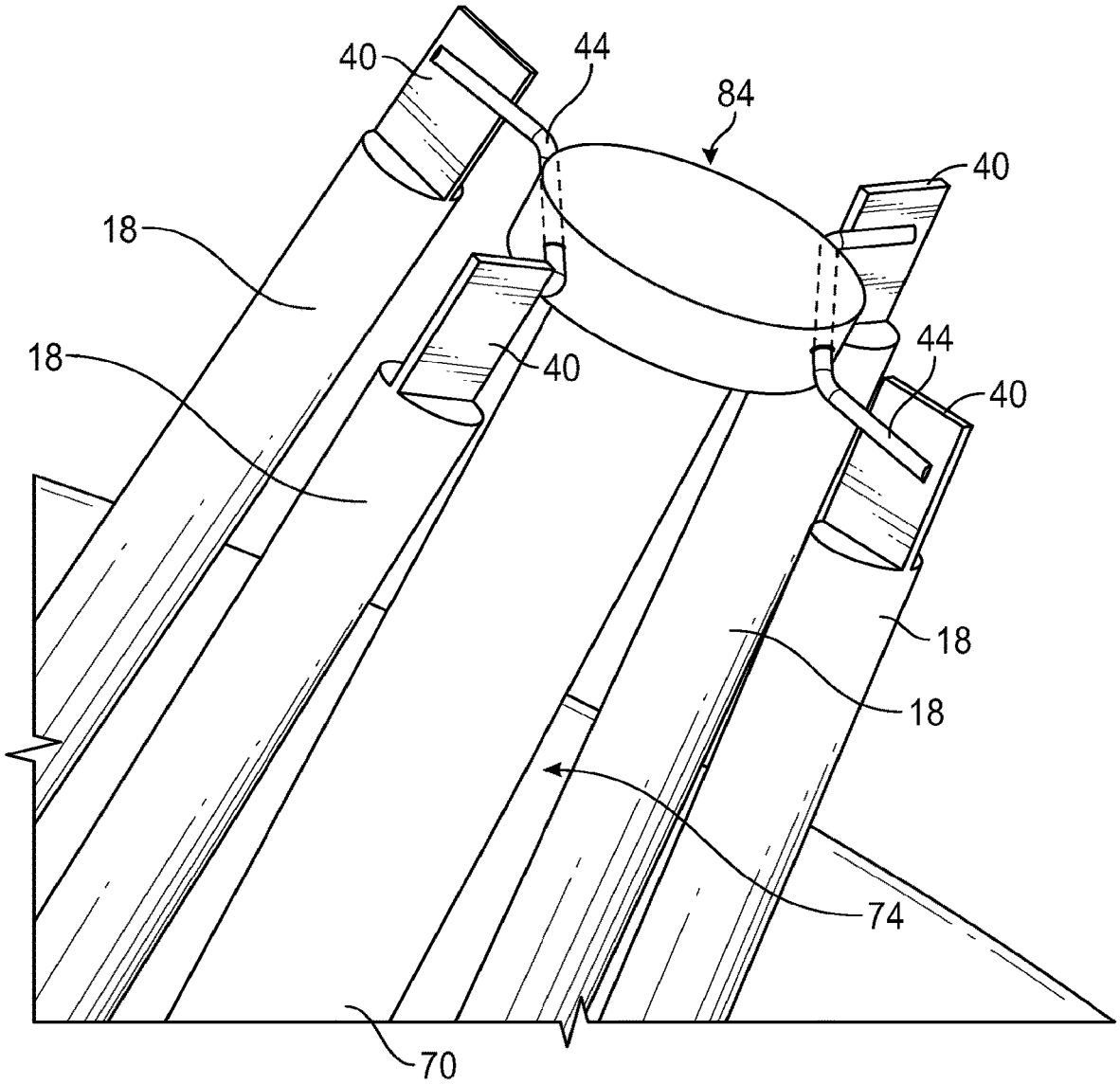
FIG. 5 is an illustration of a distal end of an elongated column of the support structure shown in FIG. 4 and the LED filaments.
Figure 7:
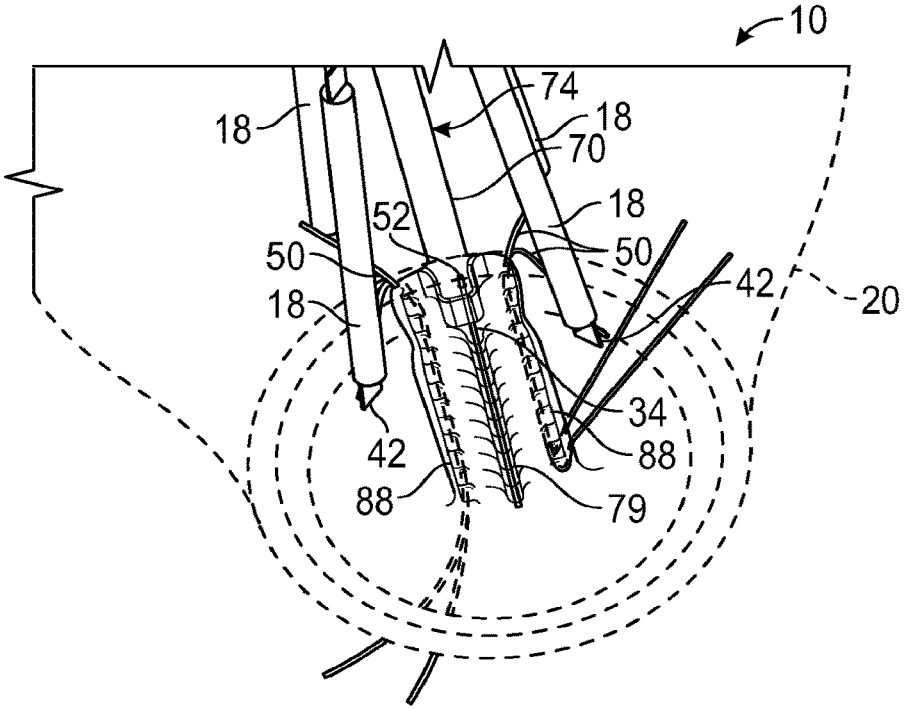
FIG. 7 is an elevational view of one embodiment of the LED filament light bulb, where the antenna is fused to the support structure.

FIG. 3 is an enlarged, elevational view of the base 22 shown in FIG. 2. Referring now to both FIGS. 2 and 3, the LED filaments 18 each include a first lead 40 and a second lead 42. The LED filaments 18 are each electrically connected to another LED filament 18 at the respective first leads 40 by first electrical conductors 44. FIG. 5 is an enlarged view of the first leads 40 of the LED filaments 18, the first electrical conductors 44, and an elongated projection or column 70 that is part of a guidewire lamp post or support structure 74, where the first electrical conductors 44 are fused to and embedded within an element of the support structure 74. Turning back to FIG. 2, the second lead 42 of each LED filament 18 is connected to a respective elongated electrical conductor 50. Each elongated electrical conductor 50 extends from the second lead 42 of one of the LED filaments 18 into the base 22 of the LED filament light bulb 10, and is electrically connected to the driver board 54. As seen in FIG. 7, the electrical conductors 50 are also fused to and embedded within the support structure 74, as explained in greater detail below.

Referring to FIG. 2, the antenna 34 is positioned to extend in a direction that is substantially parallel to and offset from an axis of symmetry A-A of the LED filament light bulb 10 (FIG. 1), and the LED filaments 18 are positioned to surround the antenna 34. Referring to both FIGS. 2 and 3, the antenna 34 defines a first end portion 51 and a second end portion 52, where the first end portion 51 of the antenna 34 is electrically connected and in signal communication with the RF driver 58. The driver board 54, the capacitor 56, and the RF driver 58 are located within the base 22 of the LED filament light bulb 10, and are surrounded by a screw shell 60 of the base 22. Referring to FIGS. 1 and 2, the second end portion 52 of the antenna 34 projects or extends in an upward direction, and towards a top portion 62 of the cover 20 (FIG. 1). In other embodiments, the antenna 34 may extend in a substantially straight line that is offset from the axis of symmetry A-A of the LED filament light bulb 10.

Figure 4:
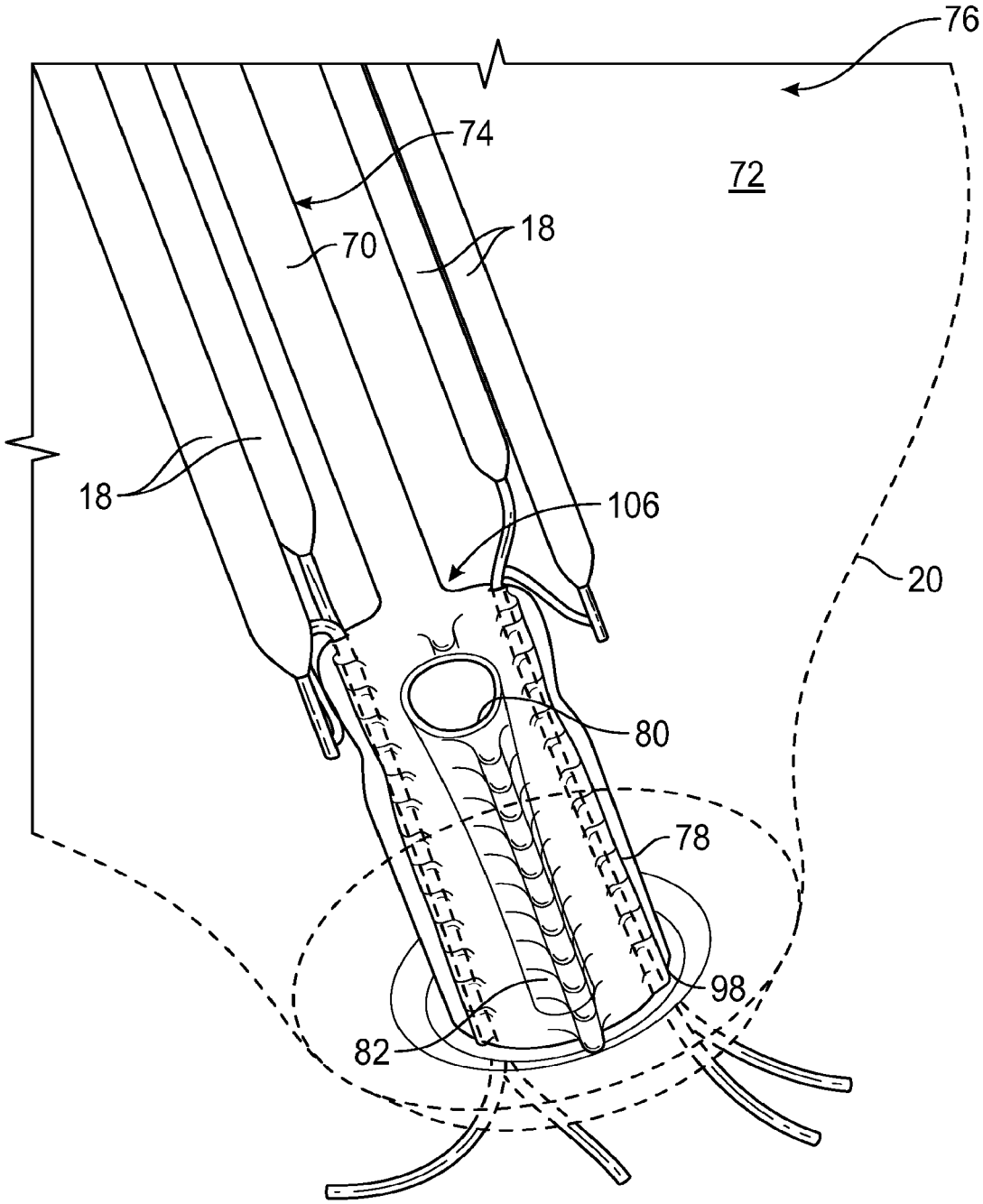
FIG. 4 is an enlarged view of the LED filament bulb illustrating a support structure that is part of the cover.
Figure 6:
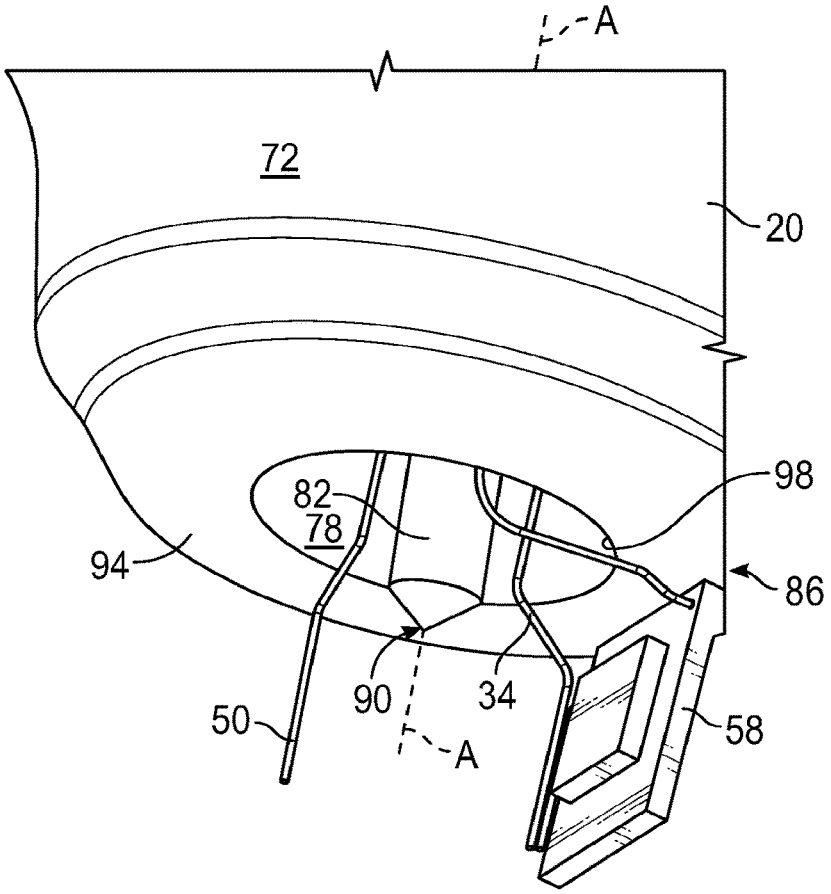
FIG. 6 illustrates a bottom portion of the cover and an evacuation passageway.

Turning now to FIG. 4, a portion of the cover 20 and the LED filaments 18 are illustrated. The cover 20 defines a external wall 72 and the guidewire lamp post or support structure 74. The support structure 74 defines a stoma or aperture 80, the elongated column 70 for supporting the elongated electrical conductors 50 and LED filaments 18 shown in FIG. 2, a cavity 78, and an evacuation passageway 82. The elongated column 70 extends into an interior volume 76 defined by the external wall 72 of the cover 20. The elongated column 70 may extend along the axis of symmetry A-A of the LED filament light bulb 10 (FIG. 1). FIG. 5 is an illustration of a distal end 84 of the elongated column 70, where the elongated column 70 is substantially solid. The first leads 40 of the LED filaments 18 are electrically connected to the first electrical conductors 44. The first electrical conductors 44 are fused to the distal end 84 of the elongated column 70. Specifically, as explained in the process flow diagram 200 in FIG. 10, the first electrical conductors 44 are fused to the elongated column 70 during manufacturing by heat. FIG. 6 illustrates a bottom portion 86 of the cover 20 as well as the evacuation passageway 82. The evacuation passageway 82 is illustrated in FIG. 6 as being sealed. Specifically, the evacuation passageway 82 defines an end 90 located at the bottom portion 86 of the cover 20, where the end 90 is closed to provide a gas-tight seal. The gas-tight seal substantially prevents the ingression of ambient air or other gases and liquids.

Turning back to FIG. 4, the interior volume 76 of the LED filament light bulb 10 contains the LED filaments 18. During manufacturing, ambient air is evacuated out of the interior volume 76. A non-reactive gas such as, for example, nitrogen or helium is introduced and fills the interior volume 76 of the cover 20.

Referring now to FIGS. 4 and 6, the external wall 72 of the cover 20 located at the bottom portion 86 is shaped to taper inwardly into a frustoconical profile. The bottom portion 86 of the cover 20 is shaped to correspond with an inner cavity 92 defined within the screw base 22 (FIG. 3). The external wall 72 of the cover 20 defines a flattened surface 94 along a bottommost portion 96 of the cover 20 (FIG. 6). The external wall 72 also defines an aperture 98 that is positioned along the flattened surface 94 of the cover 20. The aperture 98 provides access to the cavity 78 of the support structure 74. The cavity 78 extends from the aperture 98 disposed along the bottom portion of the cover 20 to a proximate end 106 of the elongated column 70.

The support structure 74 is a separate component that is fused to the cover 20 during production by heating both parts together. The cover 20 and the support structure 74 may both be constructed of glass, where the glass of both components includes a similar coefficient of thermal expansion and viscosity. This ensures that the cover 20 and the support structure 74 remain fused together after the glass has cooled. The joining of the support structure 74 to the cover 20 is explained in greater detail in the process flow diagram 200 shown in FIG. 10.

Figure 8:
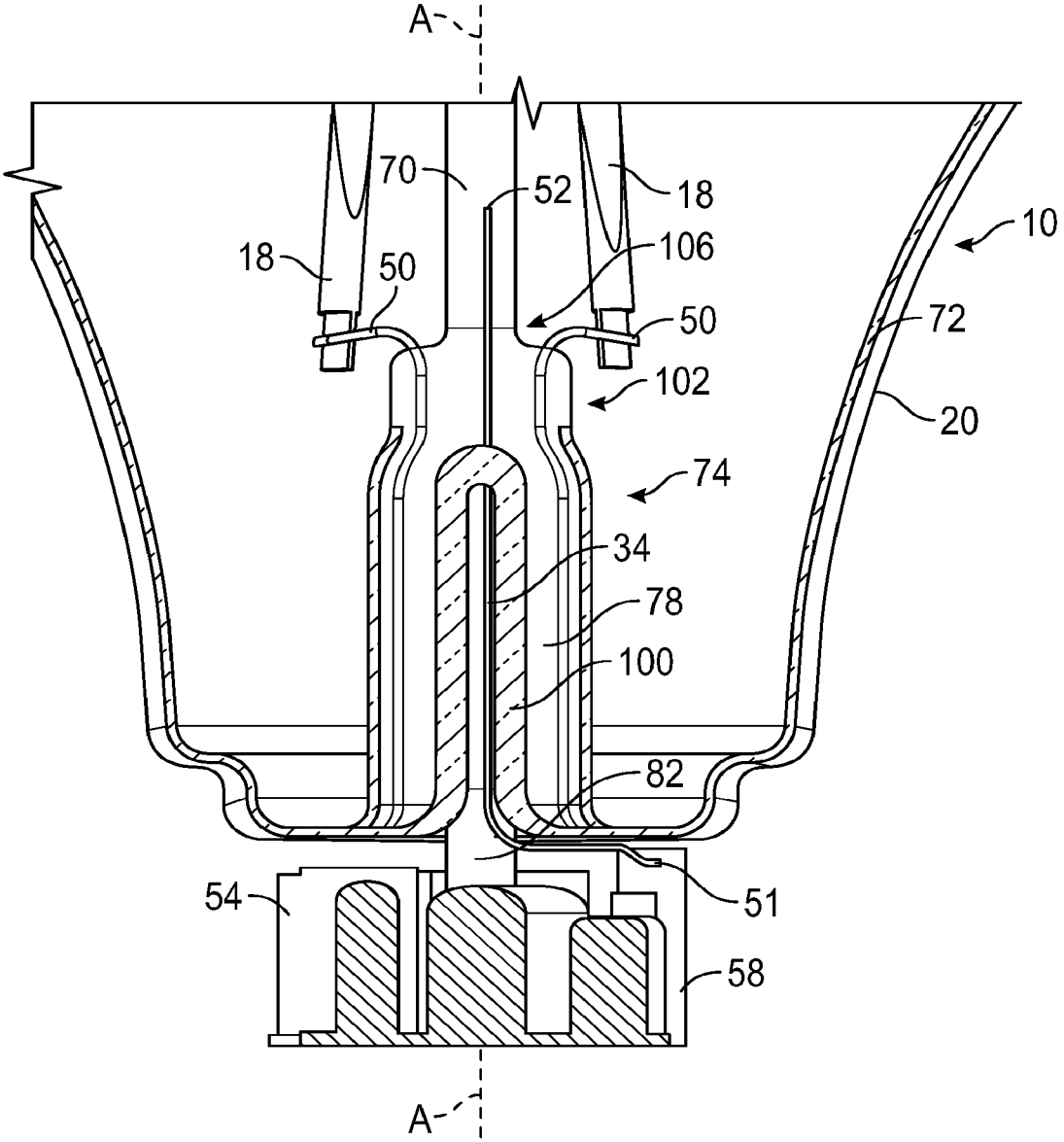
FIG. 8 is another view illustrating the LED filament light bulb shown in FIG. 7.

Referring to FIGS. 4, 6, and 8, the evacuation passageway 82 is received within the cavity 78 of the support structure 74. A portion of the evacuation passage 82 extends along the axis of symmetry A-A of the LED filament lamp 10. As seen in FIG. 4, the evacuation passage 82 extends from the aperture 80 of the support structure 74 and terminates at the end 90 (seen in FIG. 6) that is sealed. The evacuation passageway 82 is fluidly connected to the interior volume 76 of the cover 20. In the exemplary embodiment as shown in the figures, the evacuation passageway 82 is illustrated having a tubular profile. However, it is to be appreciated that the evacuation passageway 82 is not limited to a tubular profile and the figures merely illustrate one example of the evacuation passageway 82.

The end 90 of the evacuation tube 82 extends from the aperture 98 located along the flattened surface 94 of the cover 20. Before the end 90 of the evacuation tube 82 is sealed during production, the evacuation tube 82 provides access to the interior volume 76 of the cover 20. Once the interior volume 76 is evacuated of ambient air and filled with a non-reactive gas, the end 90 of the evacuation passageway 82 is heated and then pinched off to create a gas-tight seal. The gas-tight seal is used to substantially prevent the ingression of air into the interior volume 76 of the cover 20.

Figure 7A:
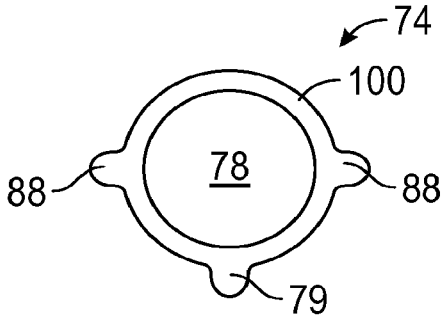
FIG. 7A is a cross-sectional top view of the support structure shown in FIG. 7.

FIG. 7 is an elevational view of one embodiment of the LED filament light bulb 10 illustrating a portion of the LED filaments 18 and the support structure 74. A portion of the cover 20 has been sectioned away in FIG. 7 to reveal the LED filaments 18 and the support structure 74. As mentioned above, each LED filament 18 includes a second lead 42 electrically connected to a corresponding elongated electrical conductor 50. Each elongated electrical conductor 50 is fused to the support structure 74 of the cover 20. FIG. 7A is a cross-sectional top view of the support structure 74. The support structure 74 is heated and then a die (not illustrated in the figures) pinches the heated glass to create two protuberances or raised sections 88. The elongated conductors 50 are encapsulated within the raised sections 88 of the support structure 74. In the embodiment as shown in FIG. 7A, the two raised sections 88 may generally oppose one another.

FIG. 8 is a cross-sectioned view of the LED filament light bulb 10 shown in FIG. 7. Referring to both FIGS. 7 and 8, the cavity 78 of the support structure 74 is defined by an internal wall 100. The elongated electrical conductors 50 are embedded within the additional glass created by pinching the heated glass of the internal wall 100 during manufacture. Accordingly, the elongated electrical connectors 50 are permanently secured and held in place within the cover 20 of the LED filament light bulb 10.

In the embodiment as shown in FIGS. 7 and 8, the antenna 34 extends in upward direction offset from the axis of symmetry A-A of the LED filament light bulb 10. The antenna 34 is secured to the cover 20 by heating the internal wall 100 of the cavity 78 and then pinching the heated glass to create another raised section 79. Similar to the conductors 50, the antenna 34 is encapsulated within the raised sections 79 of the support structure 74. In the embodiment as shown, the second end portion 52 of the antenna 34 extends through the internal wall 100 and into the interior volume 76 of the cover 20. However, in another embodiment the second end portion 52 of the antenna 34 is embedded within the raised section 79 created by heating the internal wall 100. Accordingly, the second end portion 52 of the antenna 34 is secured in place by the internal wall 100 of the cavity 78, thereby permanently securing the antenna 34 in place within the cover 20 of the LED filament light bulb 10. The elongated column 70 of the support structure 74 is positioned upon the upper portion 102 of the internal wall 100, and extends along the axis of symmetry A-A of the LED filament light bulb 10.

Figure 9:
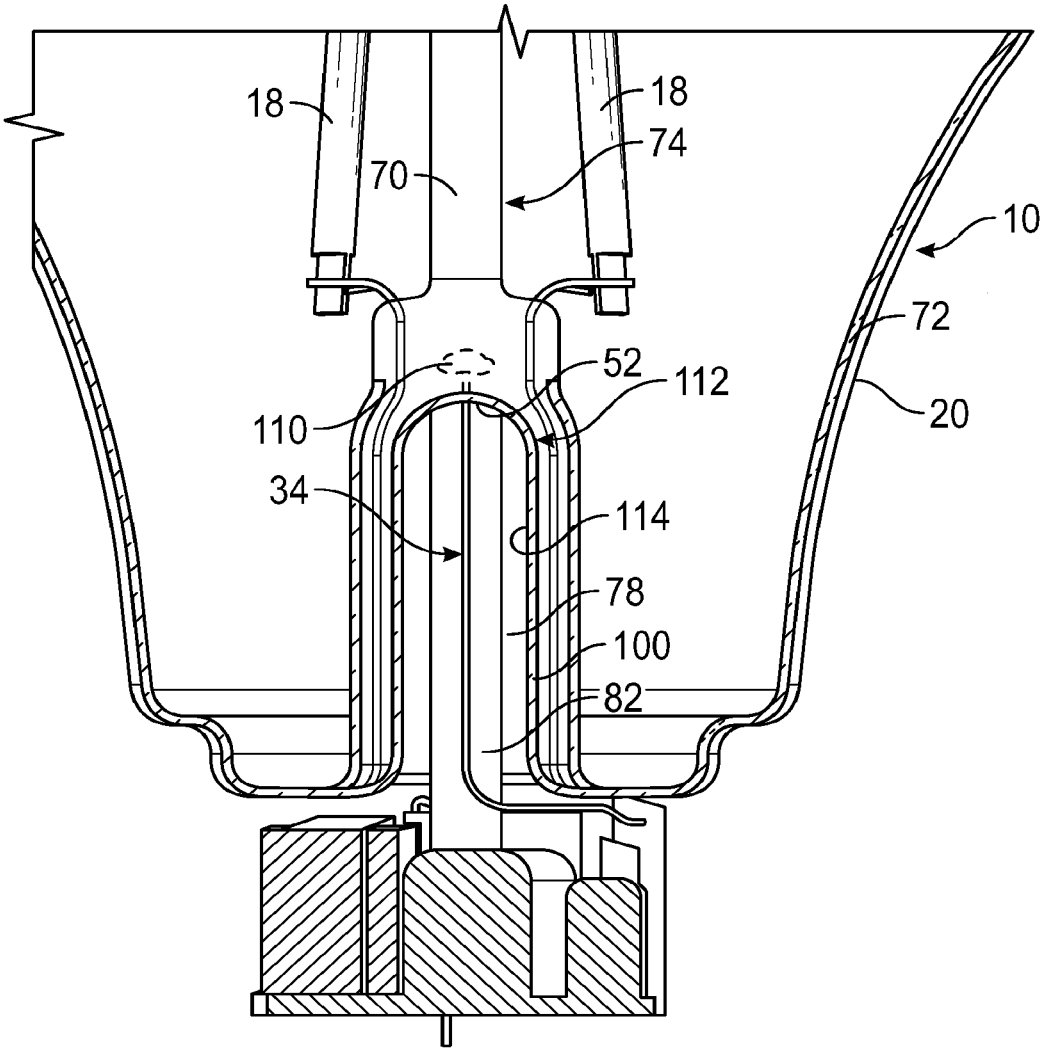
FIG. 9 is an alternative embodiment of the LED filament light bulb, where the antenna is secured to the support structure by an adhesive or epoxy material.

FIG. 9 illustrates an alternative approach for securing the antenna 34 in place using an adhesive or epoxy material 110. Specifically, in the embodiment as shown in FIG. 9, a bead of material 110 is positioned along an upper portion 112 of the cavity 78, and along an opening-side surface 114 of the internal wall 100. The second end portion 52 of the antenna 34 contacts and is embedded within the material 110. Thus, the antenna 34 is secured in place by the material 110.

Figure 10:
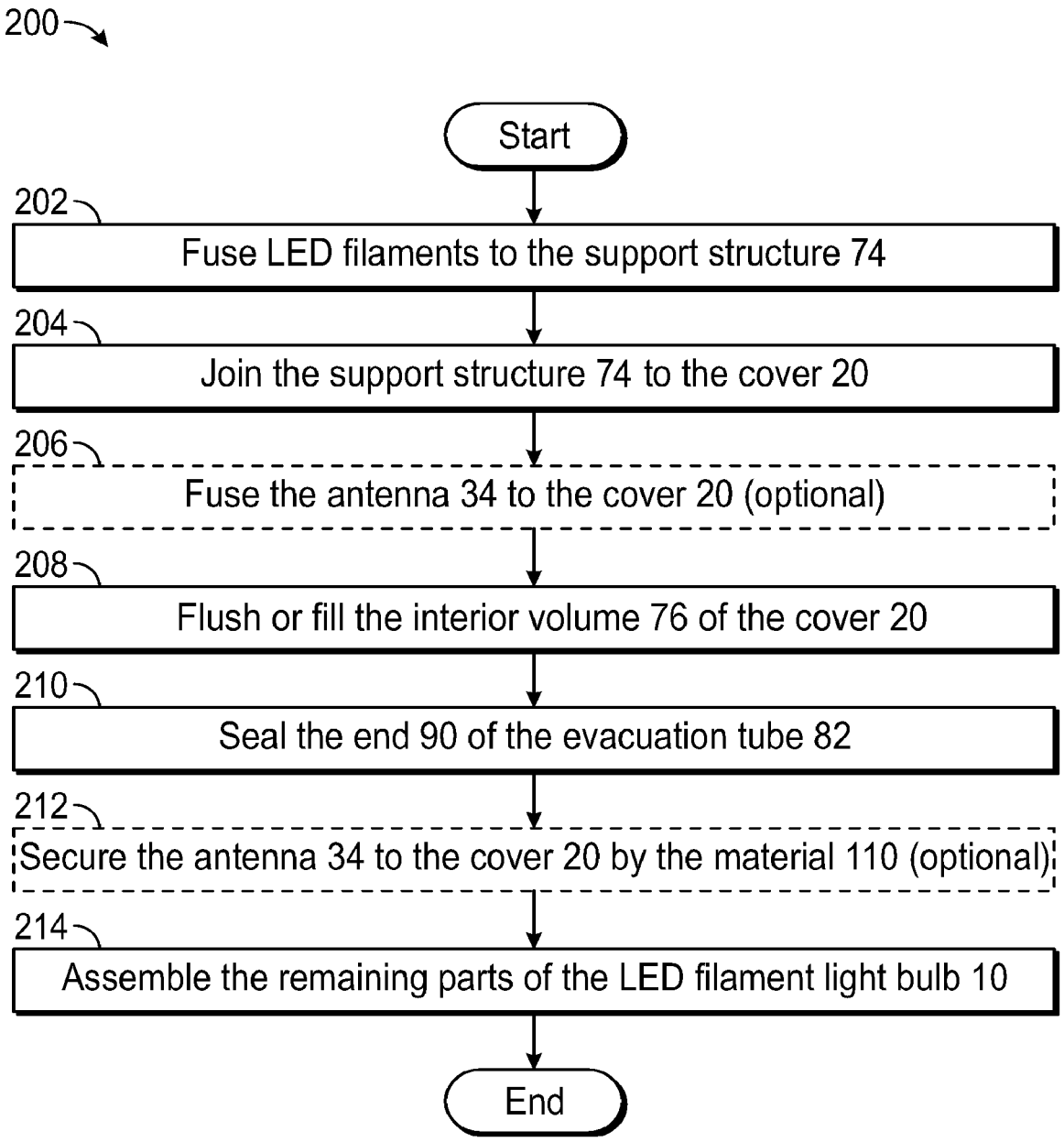
FIG. 10 is an exemplary process flow diagram illustrating a method of manufacturing the LED filament light bulb shown in FIGS. 7-9.

FIG. 10 is an exemplary process flow diagram illustrating a method 200 of manufacturing the LED filament light bulb 10 shown in FIG. 1. Referring generally to FIGS. 1-10, the method 200 begins at block 202. In block 202, the LED filaments 18 are fused to the support structure 70. Specifically, the first electrical conductors 44 connected to the first leads 40 of the LED filaments 18 are fused to the distal end 84 of the elongated column 70 (seen in FIG. 5). The elongated electrical conductors 50 connected to the second leads 42 of the LED filaments 18 are fused to the support structure 74. The support structure 74 is heated and then a die (not illustrated in the figures) pinches the heated glass, thereby encapsulating the elongated electrical conductors 50. It is to be appreciated that in block 202 the support structure 74 is not yet joined to the cover 20 (FIG. 1). The method 200 may then proceed to block 204.

In block 204, the support structure 74 is joined to the cover 20. Specifically, the support structure 74 is fused to the cover 20 by heating both parts together. Method 200 may then proceed to the next block.

Block 206 is optional, and is only performed when the antenna 34 is secured to the cover 20 as seen in FIGS. 7 and 8. In block 206, the antenna 34 is fused to the support structure 74 by first heating the glass of the support structure 74. Then, a die (not illustrated in the figures) pinches the heated glass to create the raised section 79 that encapsulates the antenna 34. The method 200 may then proceed to block 208.

In block 208, a non-reactive gas flushes or fills the interior volume 76 of the cover 20. The gas may flush ambient air out of the interior volume 76, or the ambient air may be evacuated out of the interior volume which is then filled with the gas. The method 200 may then proceed to block 210.

In block 210, the end 90 of the of the evacuation tube 82 is heated and closed to create a gas-tight seal. The method 200 may then proceed to the next block.

Block 212 is optional, and is performed when the second end 52 of the antenna 34 is secured to the cover 20 by the adhesive or epoxy material 110 as seen in FIG. 9. In block 212, the material 110 is applied to the opening-side surface 114 of the internal wall 100 of the support structure 74. The second end portion 52 of the antenna 34 is then inserted into the material 110. The method 200 may then proceed to block 214.

In block 214, the LED filament light bulb 10 is assembled together by soldering the elongated electrical conductors 50 to the driver board 54, and the first end portion 51 of the antenna 34 to the RF driver 58. The base 22 is then attached to the cover 20 to create the LED filament light bulb 10 as shown in FIG. 1. The method 200 may then terminate.

Referring generally to the figures, the disclosed LED filament light bulb integrates the antenna into the cover (via the support structure 74) during the manufacturing process. Moreover, the electrical components required for intelligent control and power are all contained within the base of the LED filament light bulb. Placing the electrical components within the base is important for aesthetic reasons, since some consumers may dislike a light bulb where such components are visible within the housing. Accordingly, a clear glass cover may be used with the disclosed LED filament light bulb. In contrast, some conventional LED filament light bulbs currently available require an opaque or frosted cover in order to conceal the visible electrical components.

While the forms of apparatus and methods herein described constitute preferred embodiments of this invention, it is to be understood that the invention is not limited to these precise forms of apparatus and methods, and the changes may be made therein without departing from the scope of the invention.

What is claimed is:

1. A method of producing a LED filament light bulb, the method comprising:

fusing a plurality of LED filaments to a support structure that is defined by a wall that forms an internal cavity that is elongated along an axis of symmetry;

joining the support structure to a cover of the LED filament light bulb, wherein the support structure is fused to the cover by heating both parts together about an opening to the internal cavity;

joining an antenna to the support structure by heating the support structure and then pinching the internal wall to create an elongated raised portion encapsulating the antenna;

flushing or filling an interior volume defined by the cover with a non-reactive gas; and heating and closing an end of an evacuation tube to create a gas-tight seal, wherein the evacuation tube is defined by the support structure and is fluidly connected to the interior volume.

2. The method of claim 1, wherein a distal end portion of the antenna is embedded within the elongated raised portion encapsulating the antenna.

3. The method of claim 1, wherein a distal end portion of the antenna extends through the wall and into the interior volume defined by the cover.

4. The method of claim 1, further comprising attaching a base to the cover after heating and closing the end of the evacuation tube.

5. The method of claim 1, wherein fusing the plurality of LED filaments to the support structure comprises heating the support structure and then pinching the internal wall to create elongated raised portions encapsulating elongated electrical conductors connected to the plurality of LED filaments.

6. The method of claim 5, wherein fusing the plurality of LED filaments to the support structure further comprises fusing electrical conductors joining members of the plurality of LED filaments to a distal end of an elongated column portion projecting along the axis of symmetry from the wall.

* * * * *